US007637005B2

(12) United States Patent
Lustenberger et al.

(10) Patent No.: US 7,637,005 B2
(45) Date of Patent: Dec. 29, 2009

(54) CABLE-PROCESSING MACHINE WITH SWIVELING DEVICE FOR SERVING PROCESSING STATIONS WITH CABLE-ENDS

(75) Inventors: Alois Lustenberger, Littau (CH); Matthias Lüscher, Lucerne (CH)

(73) Assignee: Komax Holding AG, Dierikon (CH)

( * ) Notice: Subject to any disclaimer, the term of this patent is extended or adjusted under 35 U.S.C. 154(b) by 422 days.

(21) Appl. No.: 10/670,954

(22) Filed: Sep. 25, 2003

(65) Prior Publication Data

US 2004/0068851 A1 Apr. 15, 2004

(30) Foreign Application Priority Data

Sep. 26, 2002 (EP) ..... 02405828

(51) Int. Cl.
*H01R 43/042* (2006.01)

(52) U.S. Cl. ..... 29/753; 29/33 M; 29/33 F; 29/747; 29/748; 29/861; 29/863

(58) Field of Classification Search ..... 29/753, 29/755, 33 M, 33 F, 747, 748, 749, 861, 863, 29/865, 866, 867

See application file for complete search history.

(56) References Cited

U.S. PATENT DOCUMENTS

| | | | | |
|---|---|---|---|---|
| 5,412,855 | A | 5/1995 | Koch | |
| 5,526,717 | A | 6/1996 | Koch | |
| 5,740,608 | A * | 4/1998 | Long | 29/863 |
| 6,357,575 | B1 | 3/2002 | Conte | |
| 6,658,726 | B1 * | 12/2003 | Conte | 29/753 |
| 2003/0163916 | A1 | 9/2003 | Conte | |

OTHER PUBLICATIONS annotated Figs. 5 and 8 of U.S. Appl. No. 6,658,726.*

* cited by examiner

*Primary Examiner*—Rick K Chang
(74) *Attorney, Agent, or Firm*—Fraser Clemens Martin & Miller LLC; William J. Clemens

(57) ABSTRACT

A cable-processing machine includes a swiveling device with a swiveling arm and a gripper for moving cable-ends to and from processing stations. A belt-drive advances a cable supplied from a reel or drum to a cutting and stripping station where the leading and the trailing cable-ends are cut from the cable and stripped to form a cable-length. After the leading cable-end has been processed, the cable-length is laid on a continuously driven cable transportation belt and the trailing cable-end is processed. After processing, the cable-length is laid in a cable tray.

14 Claims, 7 Drawing Sheets

CABLE-PROCESSING MACHINE WITH SWIVELING DEVICE FOR SERVING PROCESSING STATIONS WITH CABLE-ENDS

BACKGROUND OF THE INVENTION

The present invention relates to a cable-processing machine with a swiveling device for serving processing stations with cable-ends.

The European patent application EP 02405130.2 shows a swiveling device with two swiveling arms for serving a crimping device, wherein the crimping device has a first crimping station and second crimping station, each crimping station being provided with a tool-bench with tool-stations and a crimping press. A cable is advanced by means of a belt-drive, the leading end of the cable being grasped by a first gripper which is arranged on a first swiveling arm, and which takes the cable-end stripped of insulation to the first crimping station. After the leading cable-end has been fitted with a crimped contact, the first swiveling arm moves back in the axis of the belt-drive. Following this, the belt-drive advances the cable further, until the desired length of the cable is attained. A cutting and stripping station cuts the cable-length from the cable, and strips the insulation from the cable-ends. The trailing cable-end of the cable-length is grasped by a second gripper arranged on a second swiveling arm, which takes the trailing cable-end to the second crimping station to be fitted with a crimped contact. With the tool-stations arranged on a turntable, changeover from one type of contact to another type of contact is possible with minimal downtime of the crimping press.

A disadvantage of this known device is that a swiveling arm is needed for each cable-end, even though both cable-ends are subjected to the same processing. Such swiveling devices are mechanically elaborate, and require complex means of control.

SUMMARY OF THE INVENTION

The present invention provides a remedy and a solution to avoiding the disadvantages of the above-described known device and creates a swiveling device by means of which cable-processing machines which operate more compactly can be realized. The cable-processing machine according to the present invention includes: a belt-drive for providing a cable; a cutting and stripping station for cutting a cable-length from the cable and stripping leading and trailing ends of the cable-length; a pair of crimping presses for attaching a crimped contact to each of the leading and trailing ends; and a swiveling device positioned adjacent the cutting and stripping station and the crimping presses, the swiveling device having a swiveling arm with a gripper at one end for sequentially holding the leading and trailing cable-ends, the swiveling arm moving the leading and trailing cable-ends from the cutting and stripping station to the crimping presses and away from the crimping presses. The swiveling arm is pivotally mounted on the swiveling device at another end opposite the one end and a cable-axis of a one of the cable-ends being held extends parallel to a longitudinal axis of the swiveling arm when the one end of the swiveling arm is positioned at one of the crimping presses.

The cable-processing machine according to the present invention includes a platform, a turntable rotatably mounted on the platform with the swiveling arm being attached to the turntable, and a first drive attached to the platform and driving the turntable and the swiveling arm in rotation. The machine includes a second drive mounted on the platform and driving the swiveling arm linearly. The machine further includes a third drive mounted on the swiveling arm and driving the gripper in rotation. The swiveling device can be positioned either above or below a cable-line extending through the belt-drive.

The advantages achieved by the present invention are that the swiveling device serves the processing stations with only one swiveling arm, which supplies the processing stations with leading cable-ends and trailing cable-ends. On a cable-processing machine with the swiveling device according to the invention, expensive processing devices such as, for example, devices for the welding or laser-processing of cable-ends, only have to be provided once. Because of its simple construction, the swiveling device can be converted quickly and easily. The inexpensive and compactly constructed swiveling device allows good access to processing machines and cable storage. A leading or trailing cable-end can, for example, after the first processing be easily passed on a gripper to a further cable-processing machine.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
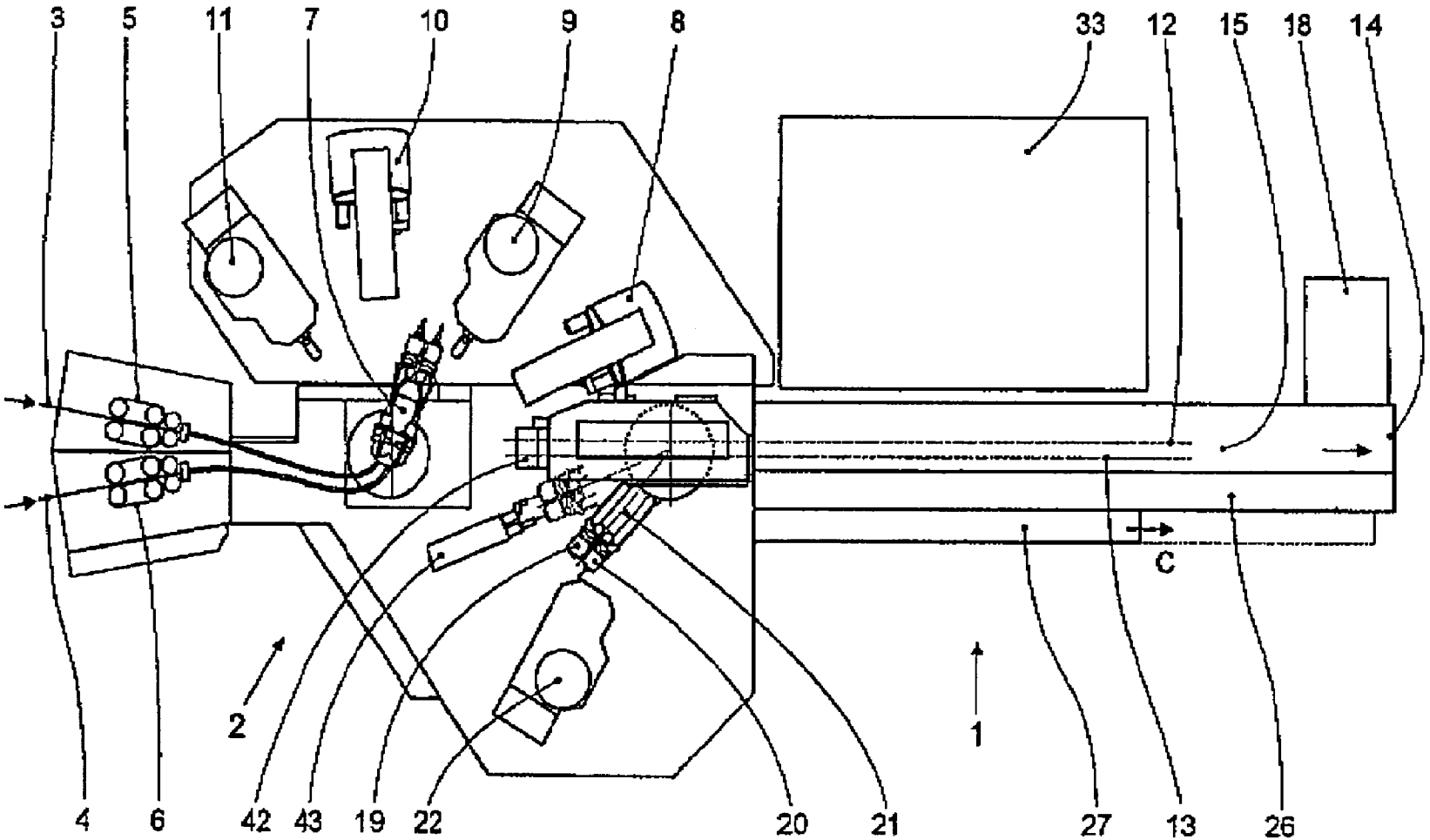
FIG. 1 is a schematic perspective view of a cable-processing apparatus in accordance with the present invention with a swiveling device arranged below a cable-line.

FIG. 1 shows a cable-processing machine 1 with a swiveling device 2 according to the present invention for serving processing stations 3, for example a pair of crimping presses 3.1, 3.2, with cable-ends. A belt-drive 4 serves to advance a cable 5 from a reel or drum (not shown). By means of a cutting and stripping station 6, a leading cable-end 5.1 and a trailing cable-end 5.2 respectively of the cable 5 are cut and stripped, a cutting knife 6.1 cutting a cable-length 5.3 from the cable 5, and a stripping knife 6.2 stripping the cable-ends 5.1, 5.2. After processing the leading cable-end 5.1, the cable-length 5.3 is laid on a continuously driven cable transportation belt 7, and the trailing cable-end 5.2 is processed. After the cable-length 5.3 has been processed, it is laid in a cable tray 8.

In the cable-processing machine 1 of FIG. 1, the swiveling device 2 is arranged below a cable-line 5.4 represented by a broken line. For handling the leading cable-end 5.1 and the trailing cable-end 5.2 respectively, the swiveling device 2 has a gripper 2.2 arranged on a swiveling arm 2.1. The swiveling device 2 can also serve processing stations arranged to the right of the cable-line 5.4 as viewed in the direction of transportation of the cable.

Figure 2:
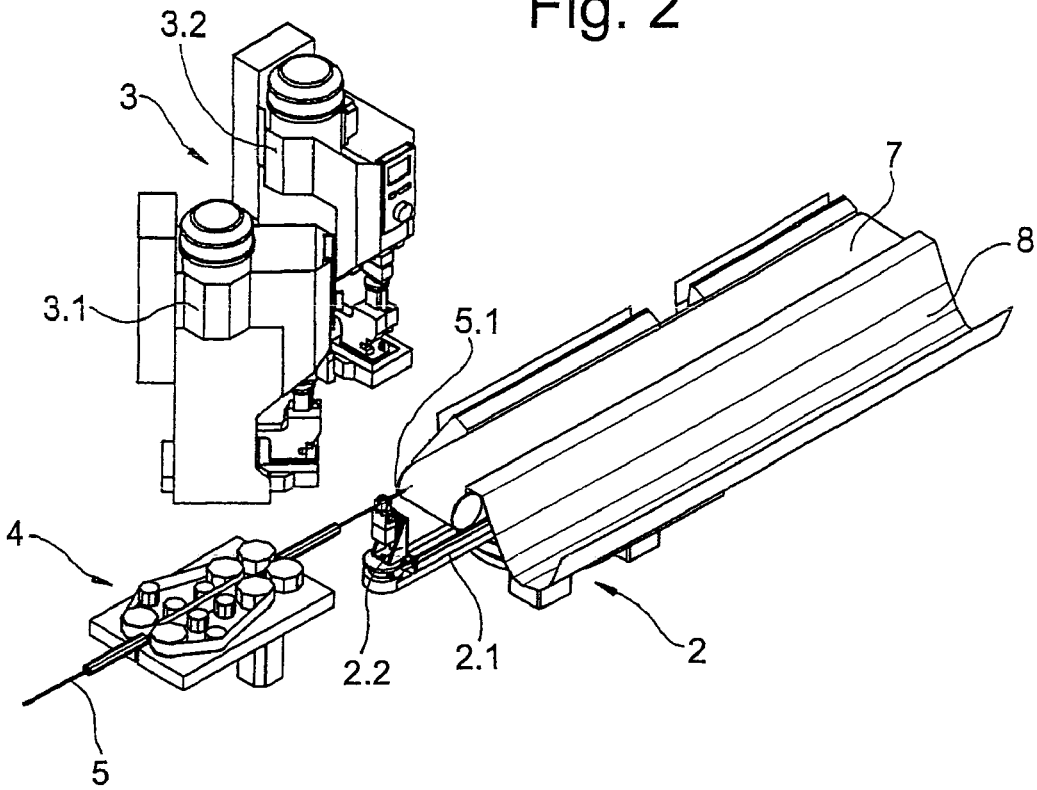
FIG. 2 to FIG. 6 are perspective views showing the apparatus of FIG. 1 performing the individual steps of a cable-end processing.

FIGS. 2 through 6 show the individual steps of a cable-end processing. In FIGS. 2 through 6, in the interest of better illustration of the functioning of the swiveling device 2, the cutting and stripping station 6 is not shown. As the processing stations 3, the first crimping press 3.1 and the second crimping press 3.2 are provided. Other processing stations such as for example, stations for welding, for laser processing, or for stripping are also possible. In FIG. 2, the gripper 2.2 of the swiveling arm 2.1 tightly holds the stripped leading cable-end 5.1.

Figure 3:
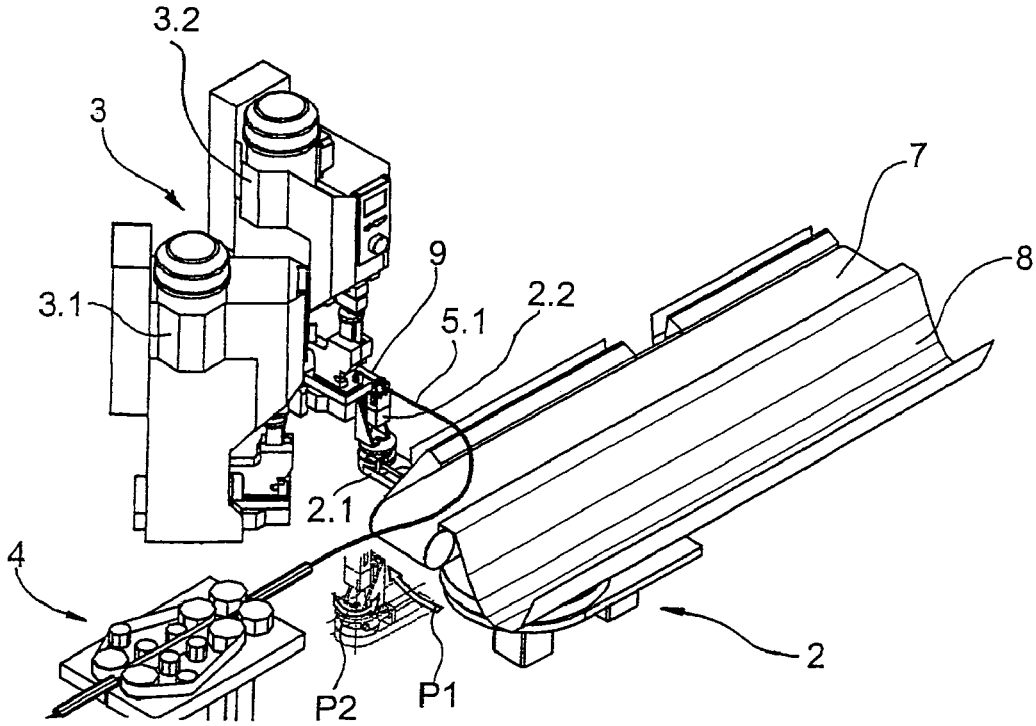

In FIG. 3, the swiveling movement of the swiveling arm 2.1 is symbolized by an arrow P1. During the swiveling movement of the swiveling arm 2.1, the gripper 2.2 executes a rotating movement symbolized by an arrow P2.

Simultaneous with the swiveling movement P1 of the swiveling arm 2.1, the belt-drive 4 advances the cable 5, the cable-axis of the cable-end 5.1 thereby running parallel to the longitudinal axis of the swiveling arm 2.1. In FIG. 3, the leading cable-end 5.1 is positioned, and ready to have a crimped contact 9 crimped onto it.

Figure 4:
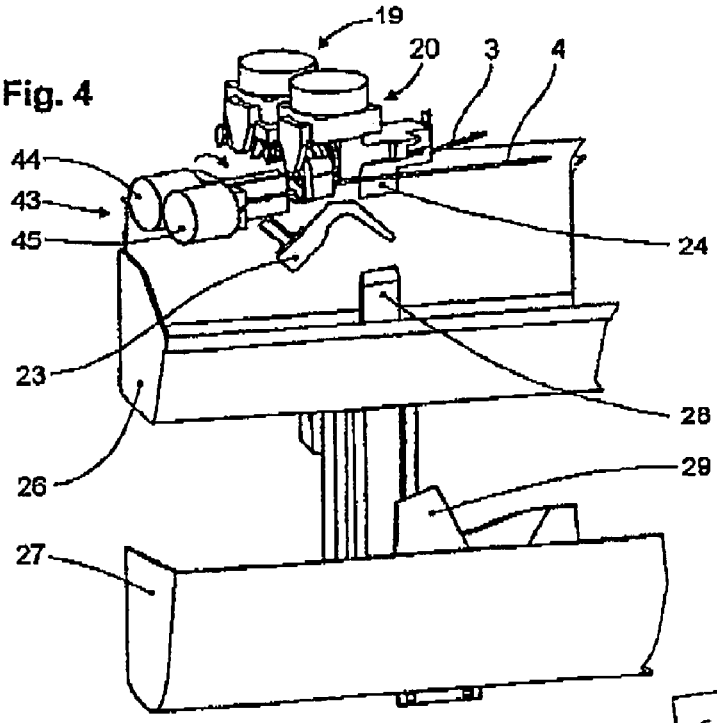
Figure 5:
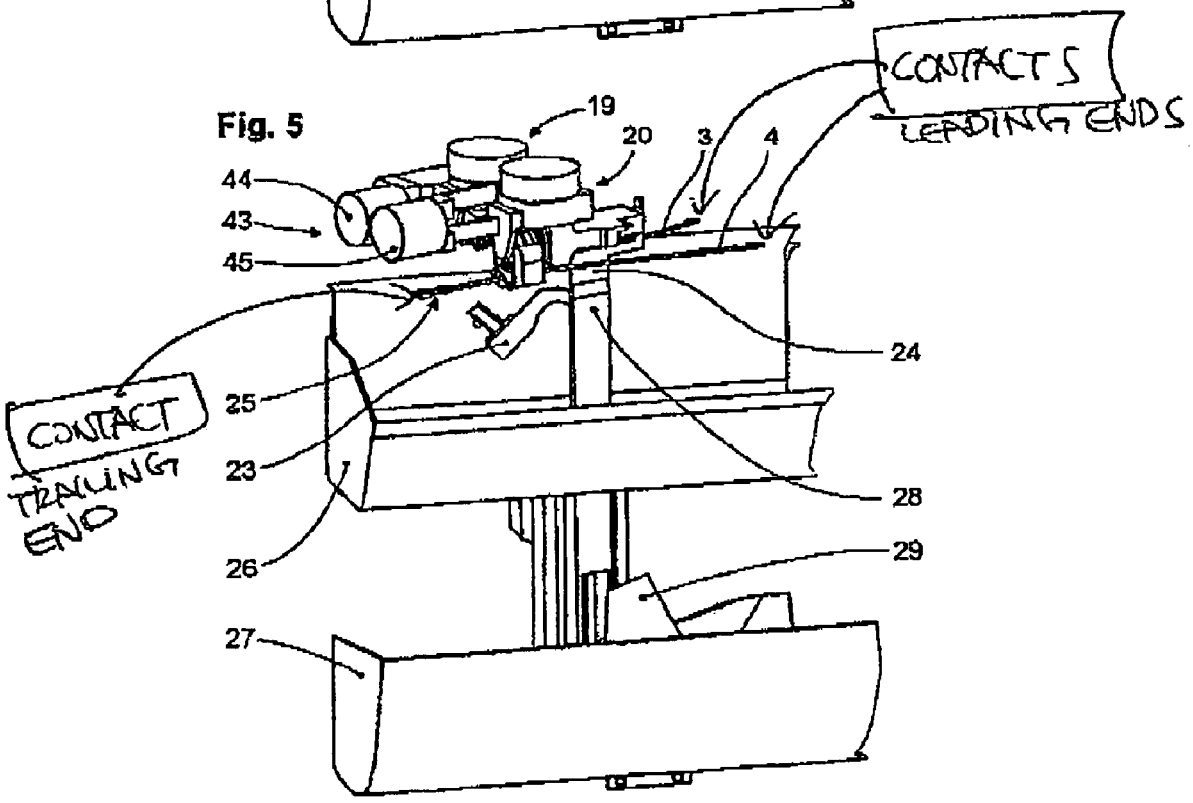

After the crimping operation, the swiveling arm 2.1 as illustrated in FIG. 4 continues the swiveling movement P1 until adjacent to the cable transportation belt 7, the belt-drive 4 advancing the cable 5. The gripper 2.2 is then opened, upon which by means of the moving transportation belt 7 the cable-end 5.1 is stretched, and by the belt-drive 4 advanced further to the desired length for the cable-length. Should short cable-lengths be desired (cable-lengths shorter than twice the length of the swiveling arm), the belt-drive 4 pulls the cable 5 back to the desired length of cable-length. After the gripper 2.2 has opened, the swiveling arm 2.1 swivels back into the starting position, and holds the cable 5 tight. After that, the cable 5 is cut and stripped by means of the cutting and stripping station 6. As illustrated in FIG. 5, the trailing cable-end 5.2 is transported by means of the swiveling arm 2.1 to the first crimping press 3.1, where it is fitted with another crimped contact 9.

Figure 6:
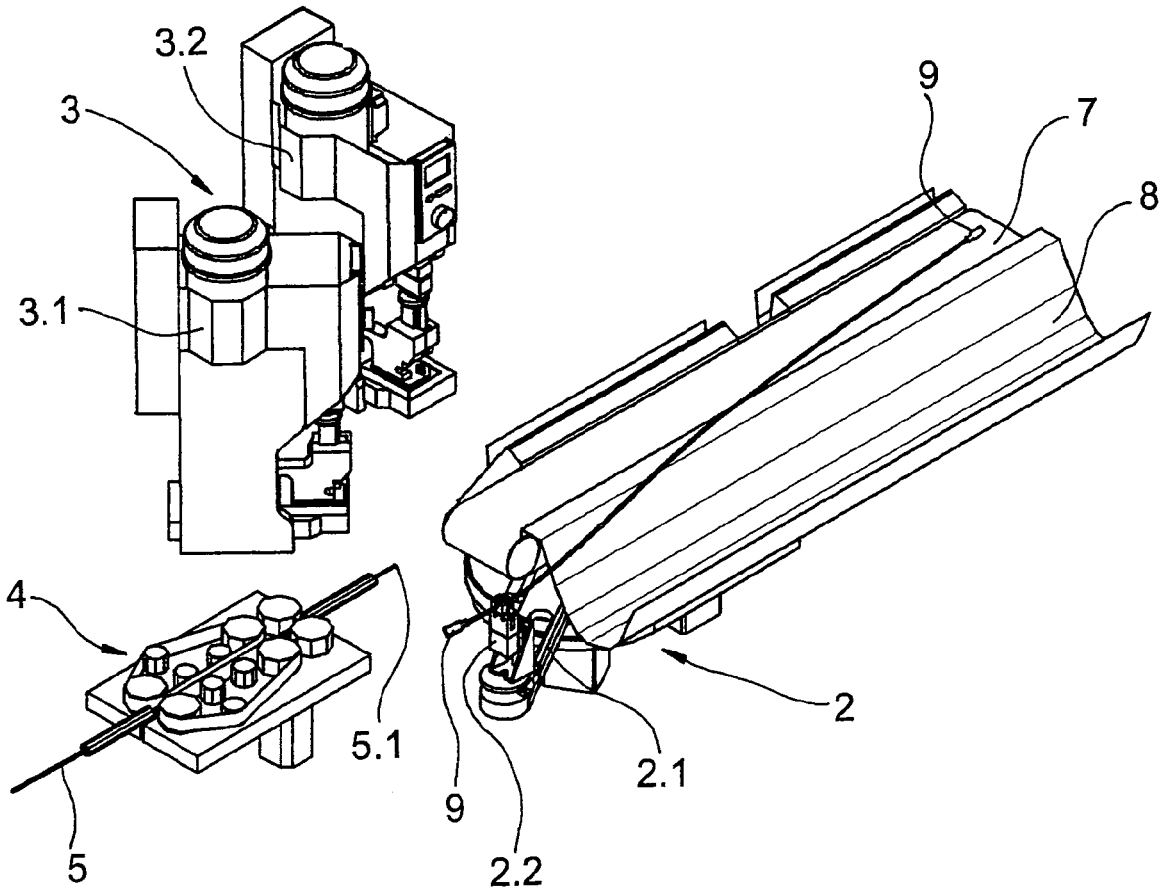

After the cable-length 5.3 has been processed, the swiveling arm 2.1 swivels as shown in FIG. 6 in the direction opposite to the swiveling movement P1 to the cable tray 8. After the gripper 2.2 opens, the cable-length 5.3 falls into the cable tray 8. After this, the swiveling arm 2.1 returns to the starting position.

Figure 7:
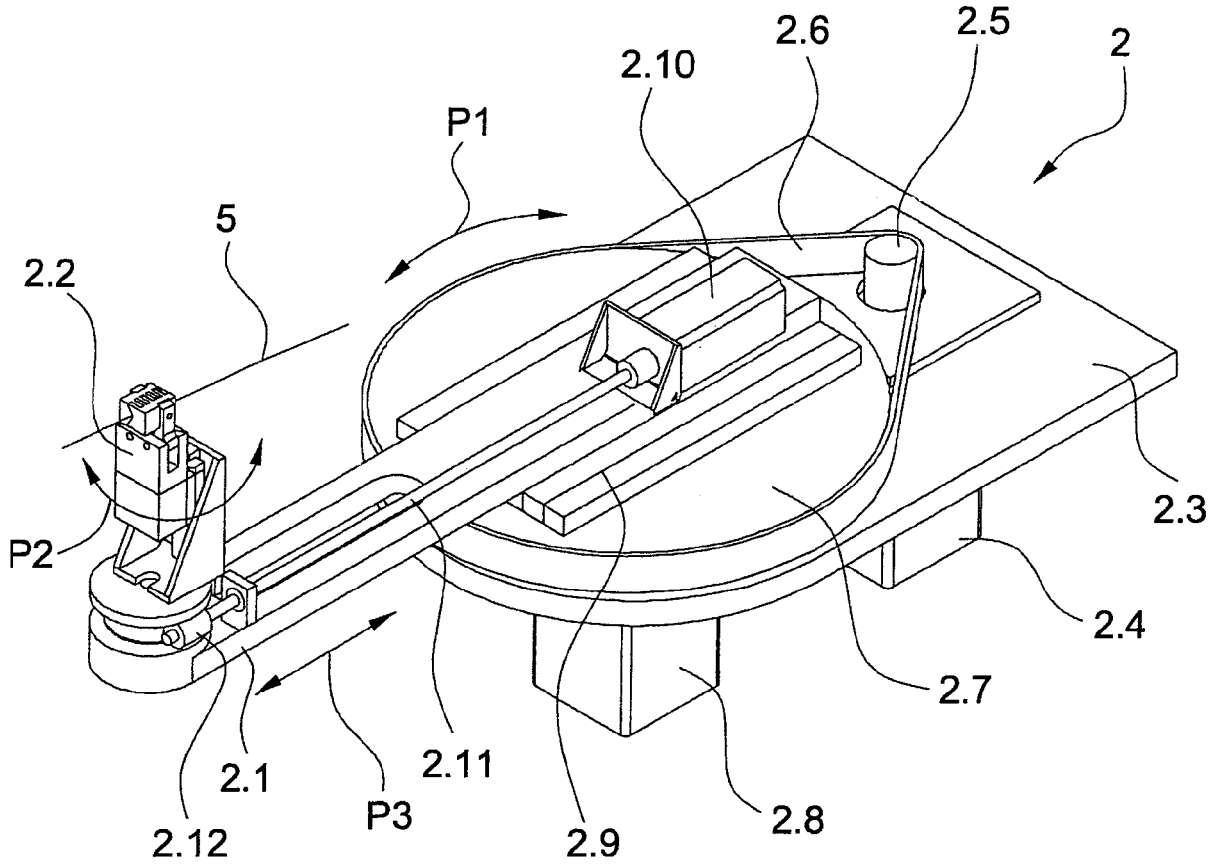
FIG. 7 is a schematic perspective view of the swiveling device shown in FIG. 1.

FIG. 7 shows details of the swiveling device 2 arranged below the cable-line 5.4. A first drive 2.4 is arranged on a platform 2.3 and drives, for example by means of a toothed pulley 2.5, a toothed belt 2.6 which itself drives a turntable 2.7 which is mounted rotatably on the platform 2.3. The movement of the turntable 2.7 is symbolized by the arrow P1. Arranged on the turntable 2.7 is a second drive 2.8, which by means of a pinion engaging in a rack moves the pivoting arm 2.1 which is guided by a longitudinal guide 2.9. The linear movement of the swiveling arm 2.1 is symbolized by an arrow P3. Arranged on the swiveling arm 2.1 is a third drive 2.10 which by means, for example, of a shaft 2.11 and a worm gear 2.12, imparts rotating movement to the gripper 2.2. The movement of the gripper is symbolized by the arrow P2. The movements P1 and P2 are explained by FIGS. 2 through 6. The movement P3 is used for positioning the gripper 2.2 in the axial direction of the cable-ends 5.1, 5.2 in the processing stations 3, or in the cutting and stripping station 6.

Figure 8:
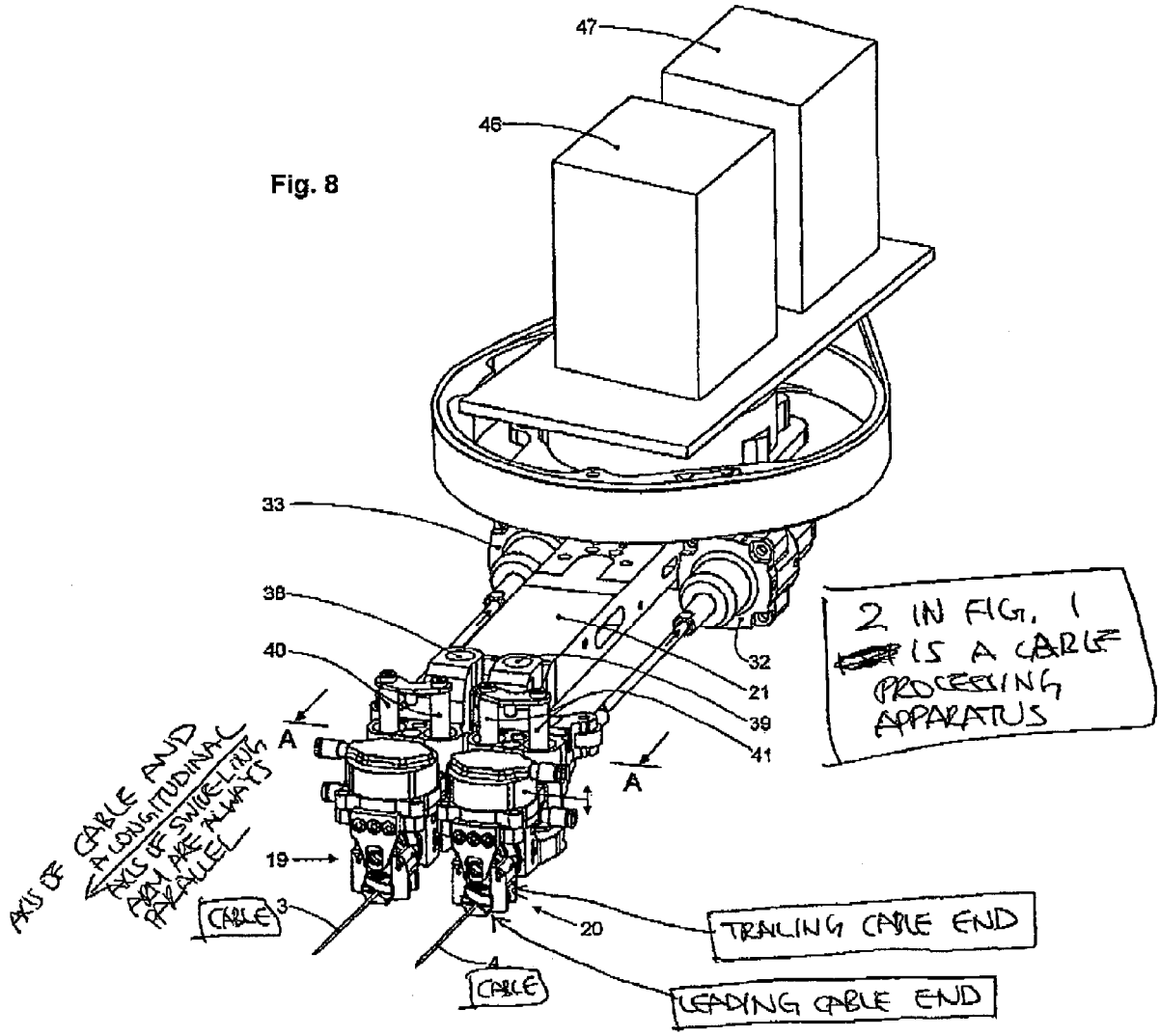
FIG. 8 is a schematic perspective view similar to FIG. 1 showing the cable-processing apparatus according to the present invention with the swiveling device arranged above the cable-line.
Figure 9:
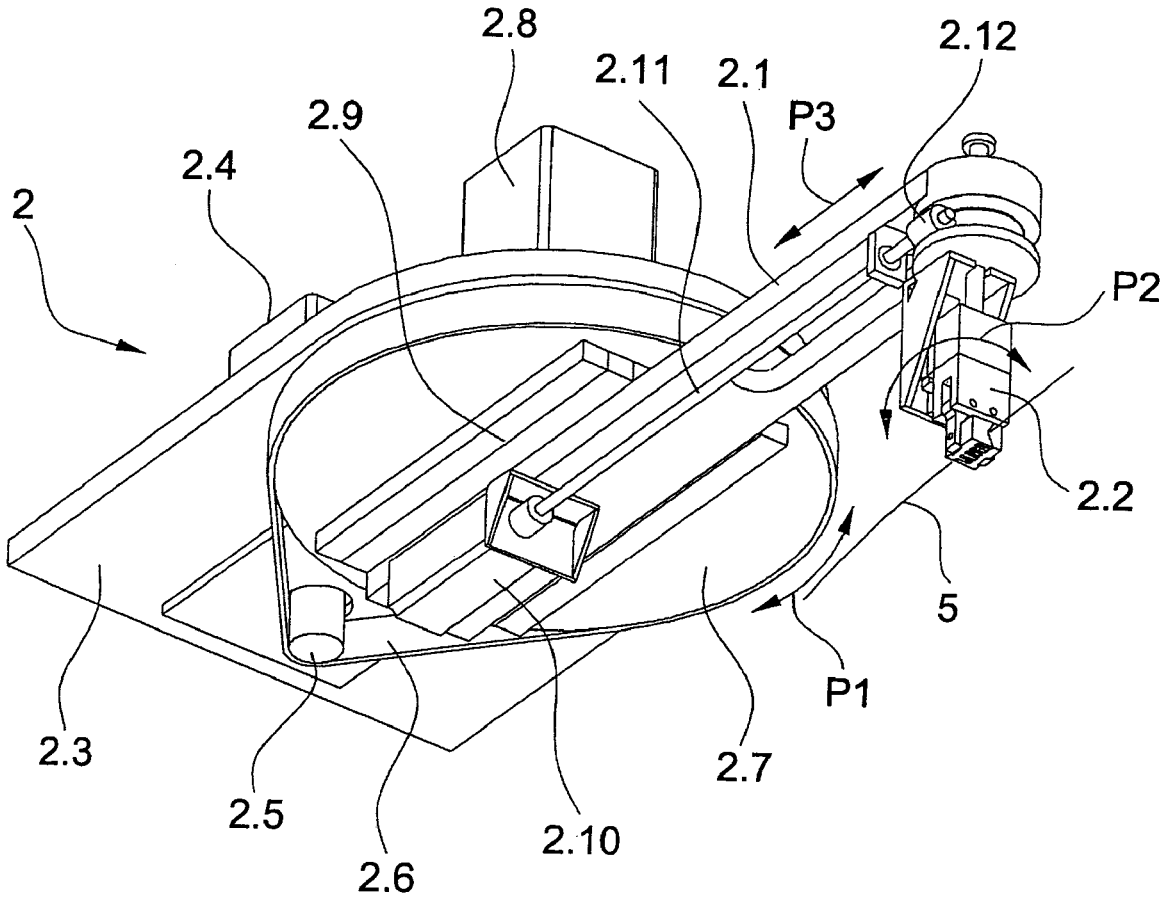
FIG. 9 is a schematic perspective view of the swiveling device shown in FIG. 8.

FIG. 8 shows a cable-processing machine 1' according to an alternate embodiment of the present invention with the swiveling device 2 arranged above the cable-line 5.4 and turned upside down. FIG. 9 shows details of the swiveling device 2 arranged above the cable-line 5.4. The constructions of the cable-processing machine 1' and the swiveling device 2 are comparable to the machine 1 and device 2 shown to FIGS. 1 through 7.

The apparatus according to FIGS. 1 through 7 allows good access to the processing machines. The apparatus according to FIGS. 8 and 9 simplifies laying the cable-length in the cable tray.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A cable-processing apparatus for positioning cable-ends at an at least one cable-end processing station of the cable-processing apparatus, the cable-ends being a leading cable-end and a trailing cable-end at opposite extents of a cable-length to be processed, comprising:

a swiveling device having a swiveling arm, said swiveling arm positioned adjacent a cutting and stripping station during a cutting and stripping of the cable-ends and the at least one cable-end processing station of the cable-processing apparatus; and a gripper mounted at one end of said swiveling arm for holding in sequence each of the leading cable-end and the trailing cable-end of the cable-length to be processed, said swiveling arm moving said gripper from said cutting and stripping station to said at least one cable-end processing station and then away from said at least one cable-end processing station, said gripper and said swiveling arm holding and moving respectively the leading and trailing cable-ends of the cable-length from said cutting and stripping station and in position for processing by said at least one cable-end processing station; and a cable transportation belt for holding the leading cable-end while said swiveling device is moving the trailing cable-end, said swiveling device mounted to the cable-processing apparatus either above or below the cable transportation belt.

2. The cable-processing apparatus according to claim 1 wherein said swiveling arm is pivotally mounted on the cable-processing apparatus at another end opposite said one end and when said one end of said swiveling arm is positioned at said at least one cable-end processing station and said gripper is holding one of the cable-ends, a cable-axis of the one cable-end being held extends parallel to a longitudinal axis of said swiveling arm.

3. The cable-processing apparatus according to claim 2 including a drive connected to said swiveling arm for swiveling said swiveling arm about said another end.

4. The cable-processing apparatus according to claim 2 including a platform, a turntable rotatably mounted on said platform with said swiveling arm being attached to said turntable, and a first drive attached to said platform and driving said turntable and said swiveling arm in rotation.

5. The cable-processing apparatus according to claim 4 including a second drive mounted on said platform and driving said swiveling arm linearly.

6. The cable-processing apparatus according to claim 5 including a third drive mounted on said swiveling arm and driving said gripper in rotation.

7. The cable-processing apparatus according to claim 1 including a drive connected to said gripper for positioning said gripper in an axial direction of one of the cable-ends being held by said gripper.

8. The cable-processing apparatus according to claim 1 including a drive connected to said gripper for rotating said gripper.

9. A cable-processing machine for processing a cable into cable-lengths with a leading cable-end and a trailing cable-end at opposite extents of the cable-lengths to which crimped contacts are attached comprising:

a belt-drive for providing the cable;

a cutting and stripping station for cutting the cable-length from the cable and stripping leading and trailing ends of the cable-length to form the leading cable-end and the trailing cable-end respectively;

a pair of crimping presses for attaching a crimped contact to each of the leading and trailing cable-ends a one of the crimped contacts; and a swiveling device having a swiveling arm positioned adjacent said cutting and stripping station during a cutting and stripping of the cable-ends and said crimping presses, said swiveling arm having a gripper at one end for sequentially holding the leading and trailing cable-ends in position for cutting and stripping by said cutting and stripping station and for processing by said at least one cable-end processing station, said swiveling arm moving the leading and trailing cable-ends from said cutting and stripping station to said crimping presses and away from said crimping presses; and a cable transportation belt for holding the leading cable-end while said swiveling device is moving the trailing cable-end, said swiveling device mounted to the cable-processing apparatus either above or below the cable transportation belt.

10. The cable-processing machine according to claim 9 wherein said swiveling arm is pivotally mounted on said swiveling device at another end opposite said one end and a cable-axis of a one of the cable-ends being held by said gripper extends parallel to a longitudinal axis of said swiveling arm when said one end of said swiveling arm is positioned at one of said crimping presses.

11. The cable-processing machine according to claim 10 including a platform, a turntable rotatably mounted on said platform with said swiveling arm being attached to said turntable, and a first drive attached to said platform and driving said turntable and said swiveling arm in rotation.

12. The cable-processing machine according to claim 11 including a second drive mounted on said platform and driving said swiveling arm linearly.

13. The cable-processing machine according to claim 12 including a third drive mounted on said swiveling arm and driving said gripper in rotation.

14. The cable-processing machine according claim 9 including a transportation belt for receiving the leading end and a cable tray for receiving the cable-length, and wherein said swiveling device is positioned adjacent said belt-drive, said crimping presses, said transportation belt and said cable tray, said swiveling device being a sole means for moving the leading and trailing cable-ends from said cutting and stripping station to said crimping presses, said transportation belt and said cable tray, wherein said gripper holds the leading end while said swiveling arm of said swiveling device rotates in a first direction to said crimping presses for processing to attach a crimped contact on the leading end, said swiveling arm of said swiveling device rotates further in the first direction to said transportation belt and said gripper releases the leading end on said transportation belt, said swiveling arm of said swiveling device rotates in a second direction, opposite said first direction, to said cutting and stripping station and said gripper holds the trailing end, said swiveling arm of said swiveling device rotates in the first direction to said crimping presses for processing to attach a crimped contact on the trailing end, and said swiveling arm of said swiveling device rotates further in the second direction, opposite said first direction, to said cable tray and said gripper releases the trailing end on said cable tray causing the cable-length to transfer from said transportation belt to said cable tray.

* * * * *